US005299742A

United States Patent [19]

Han

[11] Patent Number: 5,299,742

[45] Date of Patent: Apr. 5, 1994

[54] IRRIGATION SPRINKLER NOZZLE

[75] Inventor: Joseph U. Han, Rancho Cucamonga, Calif.

[73] Assignee: Anthony Manufacturing Corp., Azusa, Calif.

[21] Appl. No.: 69,443

[22] Filed: Jun. 1, 1993

[51] Int. Cl.[5] ..... B05B 3/10

[52] U.S. Cl. ..... 239/206; 239/246; 239/DIG. 1

[58] Field of Search ..... 239/204, 206, 246, 263, 239/DIG. 1, 230

[56] References Cited

U.S. PATENT DOCUMENTS

| | | | |
|---|---|---|---|
| 3,645,451 | 2/1972 | Hauser | 239/206 |
| 3,716,192 | 2/1973 | Hunter | 239/205 |
| 3,924,809 | 12/1975 | Troup | 239/230 |
| 3,955,764 | 5/1976 | Phaup | 239/206 |
| 4,091,997 | 5/1978 | Ridgway | 239/230 X |
| 4,434,937 | 3/1984 | Pitchford | 239/230 |
| 4,537,356 | 8/1985 | Lawson | 239/230 |
| 4,595,141 | 6/1986 | Cherundolo et al. | 239/230 |
| 4,681,259 | 7/1987 | Troup et al. | 239/206 |
| 4,840,312 | 6/1989 | Tyler | 239/206 |
| 4,867,378 | 9/1989 | Kah, Jr. | 239/206 |
| 5,086,977 | 2/1992 | Kah, Jr. | 239/206 X |
| 5,104,045 | 4/1992 | Kah, Jr. | 239/246 |
| 5,141,157 | 8/1992 | Han et al. | 239/206 |

FOREIGN PATENT DOCUMENTS

| | | | |
|---|---|---|---|
| 488610 | 12/1953 | Italy | 239/263 |

*Primary Examiner*—Andres Kashnikow
*Assistant Examiner*—Lesley D. Morris
*Attorney, Agent, or Firm*—Kelly, Bauersfeld & Lowry

[57] ABSTRACT

An irrigation sprinkler nozzle comprising a nozzle body having a range nozzle passage therethrough and a spreader nozzle disposed therebelow, the spreader nozzle being formed by a generally rectangular cross-sectional chamber having a generally rectangular cross-sectional outlet orifice, the chamber and outlet orifice being oriented with their long dimensions extending in a generally lateral direction substantially horizontal with the ground, the outlet orifice being laterally but not vertically smaller in size than the size of the chamber so that a vertically oriented fan-shaped spray pattern is produced by water projected from the outlet orifice.

10 Claims, 2 Drawing Sheets

IRRIGATION SPRINKLER NOZZLE

BACKGROUND OF THE INVENTION

This invention relates to irrigation sprinkler nozzles, and more particularly to a new and improved sprinkler nozzle construction for producing a highly controllable and enhanced spray pattern from a nozzle of the type including a primary or range nozzle and a secondary or spreader nozzle.

In many irrigation applications, particularly in commercial irrigation situations, irrigation sprinklers will employ nozzles having two or more outlets. Typically, one nozzle outlet, referred to as a "range nozzle", is designed to produce a relatively large volume stream intended to be projected outwardly from the sprinkler for maximum distance of throw, and another nozzle outlet referred to as a "spreader nozzle", is designed to produce a smaller volume stream, typically as a relatively small droplet size spray, which is intended to fall-out close in to the sprinkler for close-in watering. In some cases, a third nozzle outlet is provided to produce an intermediate range stream, the object being to insure that water is distributed over the entire area between the sprinkler and the maximum range of the water projected outwardly therefrom.

While it is relatively straight forward to design a range nozzle to achieve maximum distance of throw, it is much more difficult to design a spreader nozzle to fill in the area between the sprinkler and the doughnut shaped area of coverage produced by the range nozzle. One reason why it is more difficult to design spreader nozzles to supply close-in water is that small sized orifices and passageways have typically been required so that a relatively small droplet size spray will be produced, the finer the spray, the more rapidly the water will fall out to the ground. Small size orifices and passageways, however, suffer from being easily clogged and restricted by particulate material such as sand and dirt carried by the water, thereby rendering the nozzle ineffective. Further, such fine, sometimes mist-like sprays are difficult to control and highly susceptible to being blown by wind so that the water distribution pattern produced may be quite irregular. Moreover, the typical spray produced by prior art spreader nozzles tends to be generally conical in shape so that the spray extends laterally to the side of the range nozzle stream, thereby producing significant lateral overspray when used with part circle sprinklers.

Thus, there exists a need for a new and improved nozzle construction which will provide an effective and reliable spreader nozzle for close-in watering, yet which does not require small size orifices and passageways, and will produce a spray pattern of controlled size and shape that is substantially unaffected by wind and does not produce objectionable lateral overspray. As will become more apparent hereafter, the nozzle construction of the present invention satisfies this need in a novel and unobvious manner.

SUMMARY OF THE INVENTION

The present invention provides a new and improved sprinkler nozzle constructed in such a manner that a generally vertically oriented fan-shaped spray is produced by the spreader nozzle so that a lower portion of the spray is directed downwardly close-in to the sprinkler, and an upper portion is directed upwardly to interact with and become entrained in the stream from the range nozzle outlet. By having a portion of the spray from the spreader nozzle outlet become entrained in the stream from the range nozzle, a portion of the stream energy will be transferred to the spray, thereby carrying the spray further away from the sprinkler than would otherwise occur. By directing the lower portion of the spray from the spreader nozzle outlet downwardly, the amount of water applied in the immediate area around the sprinkler can be increased, thereby to improve overall distribution of water from the nozzle assembly without significant loss in overall range. Moreover, the fan-shaped spray from the spreader nozzle outlet is formed to have a very narrow lateral width, and can be controlled to provide a wide range of water distribution patterns, yet permits the orifices and passageways to be of relatively large size for minimizing any possibility of clogging due to particulate material carried by the supply water.

More particularly, the spreader nozzle outlet is formed to have a generally rectangular shape with the long dimension disposed to extend generally parallel with the ground and laterally of the center line through the range nozzle outlet, and is fed by water supplied to a similarly oriented generally rectangular cross-sectional chamber having a size larger than the size of the spreader nozzle outlet. Importantly, the spreader nozzle outlet has a vertical extent which is substantially the same as the vertical extent of the chamber, and a lateral width which is significantly less than the lateral distance between the chamber side walls so that water flowing through the chamber to the spreader nozzle outlet is laterally but not vertically constricted. This lateral constriction produces converging side flows which intersect along a vertical plane through the centerline of the spreader nozzle outlet, and upon the water entering the atmosphere, causes a vertical stream expansion to thereby produce the vertically oriented fan-shaped spray of relatively narrow lateral width.

The distribution of water from the nozzle can be selected and easily controlled by adjusting the fan-shaped spray produced by the spreader nozzle outlet. These adjustments include controlling the relative sizes of the spreader nozzle outlet and chamber, and providing lips and notches at the spreader nozzle outlet to direct portions of the fan-shaped spray closer to or further away from the sprinkler. These and many other features and advantages of the present invention will become more apparent from the following detailed description taken in conjunction with the drawings which disclose, by way of example, the presently preferred embodiment for carrying out the principles of the invention.

DETAILED DESCRIPTION OF PRESENTLY PREFERRED EMBODIMENT

Figure 1:
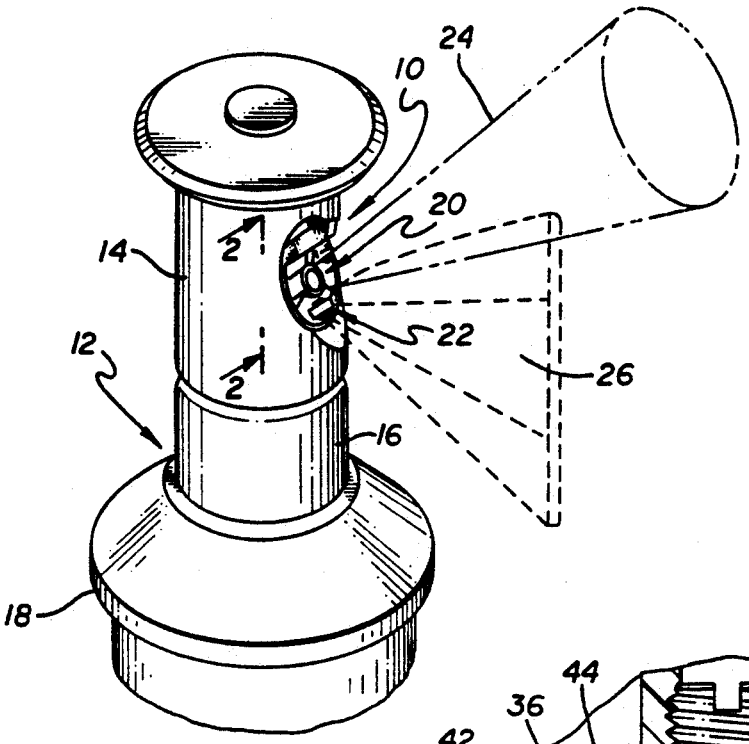
FIG. 1 is a fragmentary perspective view of a new and improved nozzle construction embodying the principles of the invention shown installed in a rotary pop-up irrigation sprinkler.

As shown in the exemplary drawings, the present invention is embodied in a new and improved sprinkler nozzle construction 10 for use in an irrigation sprinkler 12, primarily of the rotary type. In this instance, the sprinkler nozzle 10 of the invention is shown mounted to a rotary nozzle housing 14 coupled to a pop-up riser 16 supported by a sprinkler case 18, and includes a large volume water spray nozzle outlet 20, hereinafter referred to as the range nozzle outlet, and a smaller volume water spray nozzle outlet 22, hereinafter referred to as the spreader nozzle outlet. Water exiting the range nozzle outlet 20 is projected upwardly and laterally outwardly from the nozzle housing 14 as a generally columnated water stream 24, and water ejected from the spreader nozzle outlet 22 is uniquely formed to be projected laterally outwardly as a fan-shaped spray 26, as will be explained in more detail hereinafter.

The sprinkler case 18 herein is of the type adapted to be buried in the ground and coupled with a source of pressurized water (not shown), and carries an internal water driven motor (not shown) coupled with the nozzle housing 14 for rotating the same. As depicted by the arrows in FIG. 2, pressurized water admitted to the case 18 from the source passes through the case into a tubular conduit 28 formed to extend centrally through the riser 16 into the nozzle housing 14, and then is directed through a curved, elbow shaped water passage 30 formed in the nozzle housing to deliver pressurized water to the range nozzle outlet 20 and the spreader nozzle outlet 22 of the nozzle 10. In this instance, to control and enhance the distribution of water from the range nozzle outlet 20, a conventional stream break-up pin 32 in the form of an adjustable threaded screw is mounted to the nozzle housing 14 to project into the stream 24 from the range nozzle outlet.

The nozzle 10 herein is formed, preferably of molded plastic, by a generally cylindrical body 34 dimensioned to be received within a generally cylindrical cavity 36 in the nozzle housing 14, and has a converging passageway 38 leading to the range nozzle outlet 20 with an entrance end 40 disposed to be axially aligned with, and of substantially the same cross-sectional size as the cross-sectional size of the outlet from the elbow water passage 30 in the nozzle housing. Preferably, the nozzle 10 is press-fit into the cylindrical cavity 36 of the nozzle housing 14, and includes a suitable seal, herein a lip type seal 42 formed annularly around the nozzle body 34, to provide a fluid tight seal between the nozzle body and the nozzle housing. To hold the nozzle body 34 in position, the body herein includes a forwardly projecting arm 44 through which the break-up pin 32 extends from the nozzle housing 14.

In accordance with the present invention, the the nozzle 10 is constructed in such a manner that the fan-shaped spray 26 from the spreader nozzle outlet 22 is oriented in a generally vertical direction such that a lower portion of the spray will be directed downwardly toward the ground close-in to the sprinkler 12, while an upper portion of the fan-shaped spray will interact with and become entrained in the stream 24 from the range nozzle outlet 20, thereby to enhance the overall distribution of water from the spreader nozzle outlet. By having a portion of the spray 26 from the spreader nozzle outlet 22 become entrained in the stream 24 from the range nozzle outlet 20, a portion of the energy in the stream is transferred to the spray, thereby causing that portion of the spray to be carried further away from the sprinkler 12 than would otherwise occur. By directing the lower portion of the fan-shaped spray 26 downwardly so that it falls close in to the sprinkler 12, the amount of water applied to the ground in the immediate area around the sprinkler can be increased. Moreover, the spreader nozzle outlet 22 is formed in such a manner that it produces a fan-shaped spray 26 of relatively narrow horizontal width to reduce the possibility of lateral over-spray, a feature particularly advantageous when employed in a part-circle rotary sprinkler, and relatively large size water passages are used, thereby reducing the possibility of nozzle clogging and increasing the overall reliability of the nozzle assembly 10.

Toward the foregoing ends, the spreader nozzle outlet 22 receives pressurized water from a chamber 46 herein formed in the nozzle body 34 below the converging passageway 38 leading to the range nozzle outlet 20, and the chamber is, in turn, fed by an inlet opening 48 formed in the body adjacent the entrance end 40 of the converging passageway. Notably, the inlet opening 48 to the chamber 46 is formed to bleed pressurized water from the elbow passage 30 at a point where maximum water swirl is produced, thereby to increase the distance of water throw of the stream 24 from the range nozzle outlet 22, as more particularly discussed in U.S. Pat. No. 3,924,809, the disclosure of which is incorporated herein by this reference.

Figure 2:
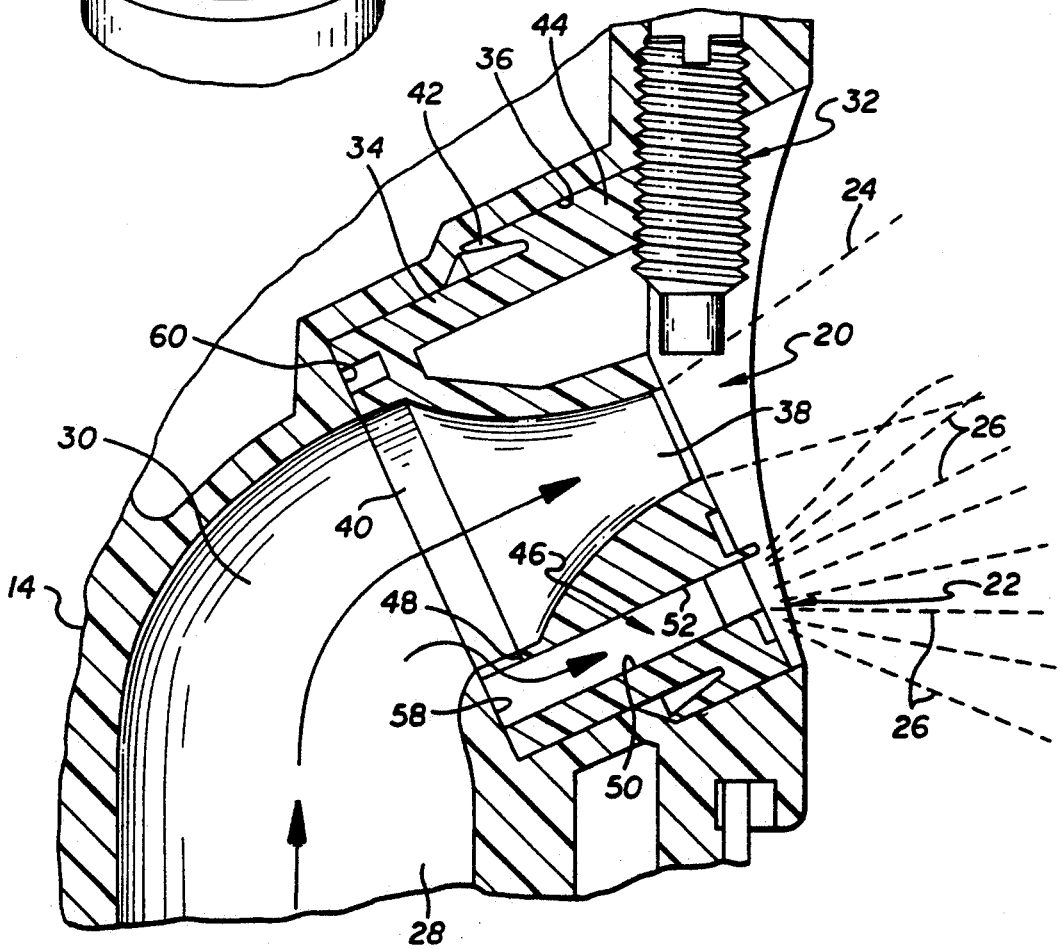
FIG. 2 is an enlarged fragmentary cross-sectional view taken substantially along line 2—2 of FIG. 1.
Figure 3:
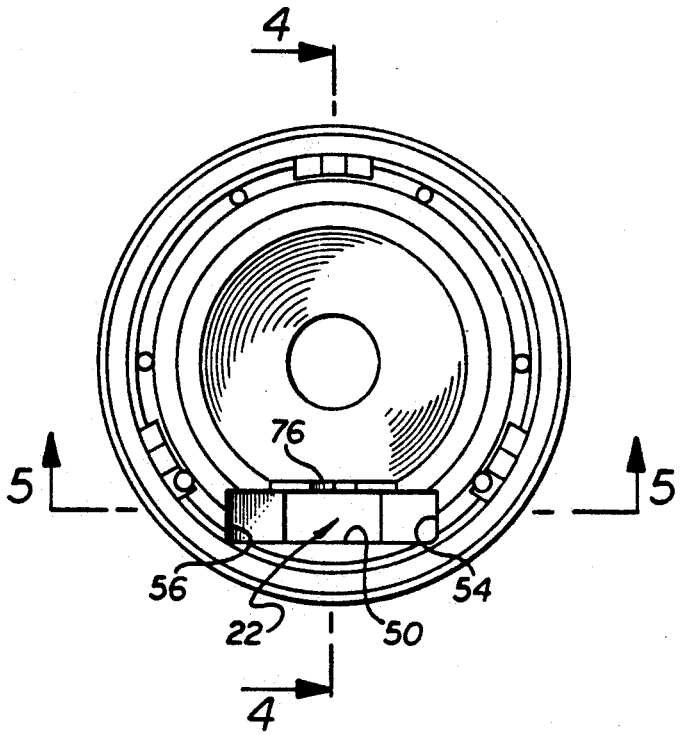
FIG. 3 is an enlarged rear elevational view of the nozzle of FIG. 1 shown removed from the sprinkler.
Figure 4:
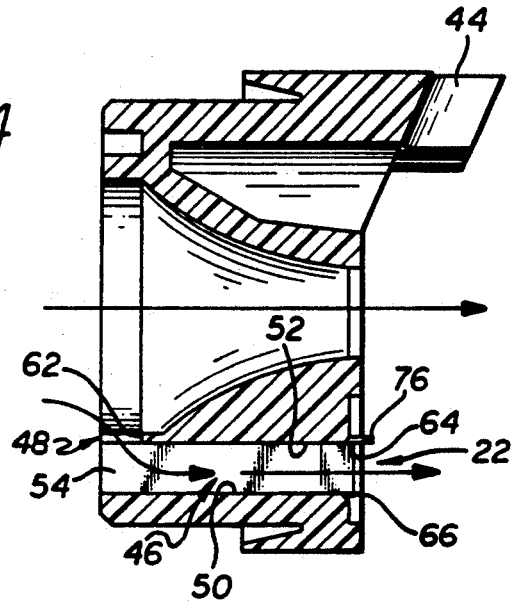
FIG. 4 is a side cross-sectional view taken substantially along line 4—4 of FIG. 3.
Figure 5:
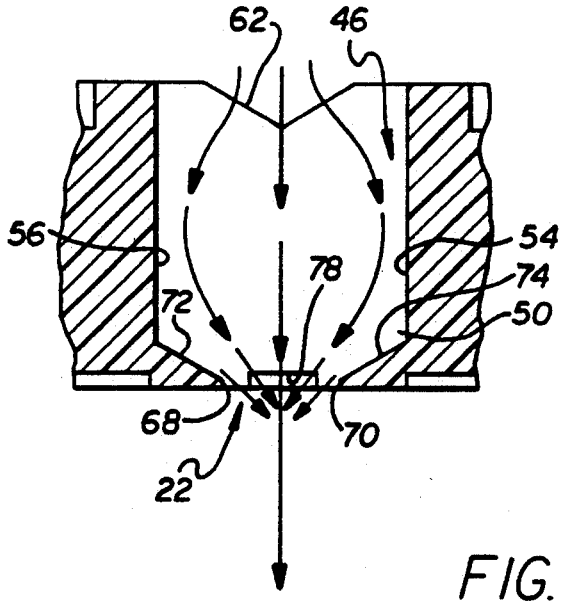
FIG. 5 is a horizontal cross-sectional view taken substantially along line 5—5 of FIG. 3.

As best seen in FIGS. 2, 4 and 5, the chamber 46 is formed in the nozzle body 34 to have a generally rectangular cross-section defined by a bottom wall 50, top wall 52 and laterally spaced side walls 54 and 56. When mounted to the nozzle housing 14, the chamber 46 herein has a rear wall 58 formed by an annulus 60 at the base of the cavity 36 within which the nozzle body is mounted. The inlet opening 48 to the chamber 46 is herein formed as a V-shaped recess or notch 62 formed in the top wall 52 at the rear of the nozzle body 34 so as to permit communication between the rear of the chamber 46 and the water flowing through the elbow passage 30 to the converging passageway 38. It should be noted that while the inlet opening 48 herein has a generally V-shape, the precise shape is not believed to be important to operation of the nozzle 10.

The spreader nozzle outlet 22 is formed at the front or outlet end of the chamber 46 to have a substantially rectangular shape with its long dimension extending laterally of the centerline through the range nozzle outlet 20 and generally horizontal with respect to the ground, and is defined by horizontal upper and lower sides 64 and 66, respectively, and vertical ends 68 and 70. Importantly, the lateral spacing between the ends 68 and 70 is substantially less than the lateral spacing between the side walls 54 and 56 of the chamber 46, while the vertical spacing between the upper and lower sides 64 and 66 is substantially the same as that between the top wall 52 and bottom wall 50 so that the upper and lower sides effectively form extensions of the top and bottom walls. With this construction, the chamber 46 thus includes a pair of front walls 72 and 74 extending respectively from the side wall 54 to the end 70 of the spreader nozzle outlet 22, and from the side wall 56 to the end 68. Thus, the cross-sectional size of the chamber 46 is larger than the cross-sectional size of the spreader nozzle outlet 22.

As schematically illustrated by the arrows in FIG. 5, pressurized water entering the chamber 46 through the inlet opening 48 will expand within the chamber as it flows toward the spreader nozzle outlet 22. To pass through the spreader nozzle outlet 22, however, the water flow must constrict laterally due to the presence of the front walls 72 and 74. This lateral constriction produces side flows of water which are directed laterally inwardly toward each other to intersect at a vertical plane through the centerline of the spreader nozzle outlet as the water passes between the ends 68 and 70 of the spreader nozzle outlet 22. Upon exiting the spreader nozzle outlet 22 and entering the atmosphere, the pressurized and accelerated water stream expands, and the side sprays converge and impinge, thereby causing a vertical water expansion producing the vertically oriented fan-shaped spray 26. It should be noted that although the front walls 72 and 74 are herein shown as sloping from the side walls 54 and 56 toward the nozzle outlet 22, this slope is not believed to have any significant effect on formation of the fan-shaped spray 28, and the walls could equally be formed to be perpendicular to side walls 54 and 56.

An important control feature of the present invention is that of being able to select the distance the fan-shaped spray 28 is projected outwardly from the spreader nozzle outlet 22. This control is made possible by selecting the cross-sectional area ratio of the inlet opening 48 with respect to the spreader nozzle outlet 22 to produce a desired pressure drop across the inlet opening. By controlling the pressure drop across the inlet opening 48, the pressure within the chamber 46 can be selected to project the fan-shaped spray 28 outwardly a desired distance to achieve the desired close-in water distribution.

More particularly, the smaller the relative size of the inlet opening 48, the greater will be the pressure drop into the chamber 46, and the less will be the distance the fan-shaped spray 28 will be projected outwardly away from the spreader nozzle outlet 22. Conversely, if the relative area of the inlet opening 48 approaches the size of the relative area of the spreader nozzle outlet 22, the pressure within the chamber 46 will be large causing the fan-shaped spray 28 to project further away from the spreader nozzle outlet 22. Thus, by controlling the pressure drop between the inlet opening 48 and spreader nozzle outlet 22, the fan-shaped spray 28 can be moved closer to or further away from the nozzle 10, thereby to, respectively, increase or decrease the distribution of water close in to the sprinkler 12.

Further, as best seen in FIG. 4, an outwardly projecting lip 76 can be provided along the upper edge of the spreader nozzle outlet 22 to "clip" and forwardly divert the upper portion of the fan-shaped spray 26 to cause that portion to be deflected outwardly and enter the stream 24 from the range nozzle outlet 20 further downstream. Such a "clipping" of the fan-shaped spray 26 may be desirable to increase the distance of throw of the stream from the range nozzle outlet 24 by reducing the amount of disruption of the stream 24 caused by impingement of the fan-shaped spray. In this connection, by selecting the extent to which the upper portion of the fan-shaped spray 26 intersects the stream 24 from the range nozzle outlet 20, the distribution of water from the spreader nozzle outlet 22 can be controlled since the more water from the spreader nozzle outlet that is permitted to intersect the stream from the range nozzle outlet, the further outwardly from the sprinkler 12 that portion will be carried by the range nozzle stream before falling to the ground. Additionally, an outwardly open notch 78 can be formed in the forward edge of the lower side 66 of the spreader nozzle outlet 22 to permit the lower portion of the fan-shaped spray 26 to be moved closer to the sprinkler 12 for further increasing the distribution of water close in to the sprinkler.

It is important to note that with the construction of the spreader nozzle chamber 46 and spreader nozzle outlet 22, a wide range of control is placed on the ability to select water distribution from the spreader nozzle outlet. Since it is well recognized that the higher the water pressure of a stream entering a nozzle, the further the water will be projected outwardly from the nozzle, the ratio of the cross-sectional size of the inlet opening 48 to the cross-sectional size of the spreader nozzle outlet 22 can be made to produce a fan-shaped spray 26 of any desired size and distance of throw. The critical aspect is that the chamber 46 have a substantially rectangular cross-section and that the spreader nozzle outlet opening 22 be similarly of rectangular shape and smaller in lateral size than the lateral size of the chamber. With this relationship, for any given ratio of the size of the inlet opening 48 to the size of the spreader nozzle outlet 22, the distance of throw and the angle of the fan-shaped spray 26 produced can be selected by controlling the supply pressure of water entering the nozzle 10. That is, the higher the pressure of water entering the nozzle 10, the greater the pressure of the side sprays produced by the end walls 72 and 74, and hence, the wider in vertical dimension the resultant fan-shaped spray 26 that will be produced. The wider the vertical dimension of the fan-shaped spray 26 that is produced, the more the upper portion of the fan-shaped spray will impinge the stream 26 from the range nozzle outlet 20, and the closer into the sprinkler 12 the lower portion of the fan-shaped spray will fall out to the ground. Further, the upper and lower portions of the fan-shaped spray can be controlled, respectively, by appropriately selecting the sizes and extent of the lip 76 and the notch 78 at the spreader nozzle outlet 22 thereby to provide an additional control over the distribution pattern of water from the nozzle 10.

From the foregoing, it should be apparent that the sprinkler nozzle construction 10 of the invention provides a significant improvement over nozzles of the prior art by producing a vertically oriented fan-shaped spray from the spreader nozzle outlet 22 which can be precisely and easily controlled to meet a wide range of operational conditions. Further, with the present invention, relatively large size inlet openings 48 and spreader nozzle outlet openings 22 are employed thereby substantially reducing the possibility of nozzle clogging by sand, dirt, and other particulate materials. Since the fan-shaped spray 26 from the spreader nozzle outlet 22 is formed as a relatively narrow, vertically oriented fan, the nozzle 10 of the invention is particularly desirable when used with part circle sprinklers since overspraying to the side of the nozzle is substantially eliminated.

While a particular form of the present invention has been illustrated and described, it will also be apparent that various modifications and variations can be made without departing from the spirit and scope of the invention as defined by the following claims.

What is claimed is:

1. An irrigation sprinkler nozzle of the type including a nozzle housing having a range nozzle portion formed by a generally cylindrical converging passageway adapted to project a columnated water stream outwardly over a relatively long distance, and a spreader nozzle portion disposed vertically below said range nozzle portion and adapted to project a water spray outwardly over a relatively short distance, said spreader nozzle portion comprising:

an elongated chamber formed in said housing below said range nozzle passageway, said chamber having a generally rectangular cross-section defined by spaced top and bottom generally horizontally disposed walls, and laterally spaced generally vertical side walls;

water inlet means formed in said housing upstream of said range nozzle passageway for directing water into one end of said chamber; and water outlet means at an end of said chamber remote from said one end for producing a generally vertically oriented fan shaped spray of relatively narrow lateral width, said water outlet means being oriented such that an upper portion of said fan shaped spray intercepts said stream from said range nozzle.

2. An irrigation sprinkler nozzle as set forth in claim 1 wherein said water outlet means comprises a generally rectangular shaped outlet orifice formed in said housing, said outlet orifice being defined by spaced upper and lower generally horizontal sides formed as extensions of said spaced top and bottom walls of said chamber, and laterally spaced, generally vertical ends disposed laterally inwardly of said vertical side walls of said chamber, whereby pressurized water flowing through said chamber from said inlet means to said outlet orifice is laterally but not vertically constricted as it passes through said outlet orifice to produce said generally vertically oriented fan-shaped spray of relatively narrow lateral width.

3. An irrigation sprinkler nozzle as set forth in claim 2 wherein said outlet orifice is centrally disposed with respect to said side walls of said chamber, said chamber including front walls extending between said side walls and said ends of said orifice, said front walls serving to laterally constrict water flowing through said chamber and to produce laterally inwardly converging side flows which intersect at a vertical plane through the centerline of said outlet orifice.

4. An irrigation sprinkler nozzle as set forth in claim 3 wherein said inlet means has a cross-sectional area less than the cross-sectional area of said outlet orifice.

5. An irrigation sprinkler nozzle as set forth in claim 3 wherein an outwardly projecting lip is formed on said housing above said outlet orifice, said lip being disposed to intercept and divert forwardly said upper portion of said fan shaped spray projected from said outlet orifice.

6. An irrigation sprinkler nozzle as set forth in claim 3 wherein said outlet orifice includes an outwardly open notch formed in said lower side centrally between said ends.

7. An irrigation sprinkler nozzle of the type including a nozzle housing having a range nozzle portion formed by a generally converging passageway leading to a range nozzle outlet and adapted to project a water stream outwardly over a relatively long distance, and a spreader nozzle portion disposed below said range nozzle portion and adapted to project a water spray outwardly over a relatively shorter distance, said spreader nozzle portion comprising:

an elongated chamber formed in said housing, said chamber having a generally rectangular shaped cross-section defined by vertically spaced top and bottom walls and laterally spaced side walls;

water inlet means formed in said housing upstream of said range nozzle outlet for directing water into one end of said chamber;

water outlet means at an end of said chamber remote from said one end, said outlet means having a generally rectangular shaped outlet opening of a cross-sectional size larger than the cross-sectional size of said inlet means, said outlet opening being formed by vertically spaced upper and lower walls coextensive with said vertically spaced top and bottom walls, and laterally spaced generally vertically directed end walls disposed laterally inwardly of said laterally spaced side walls, whereby water flowing from said inlet means to said outlet through said chamber is laterally but not vertically constricted as it passes through said outlet opening to produce a generally vertically oriented fan shaped spray.

8. An irrigation sprinkler nozzle as set forth in claim 7 wherein said outlet opening is centrally disposed with respect to said side walls of said chamber, said chamber including front walls extending between said side walls and said end walls of said outlet opening, said front walls serving to laterally constrict said water flowing through said chamber to said outlet opening.

9. An irrigation sprinkler nozzle as set forth in claim 8 wherein an outwardly projecting generally horizontally dispose lip is formed on said housing above said outlet opening, said lip being disposed to intercept an upper portion of said fan shaped spray projected from said outlet opening.

10. An irrigation sprinkler nozzle as set forth in claim 9 wherein an outwardly opening notch is formed centrally in said lower wall of said outlet opening.

* * * * *